United States Patent [19]

Jones

[11] 4,081,930

[45] Apr. 4, 1978

[54] ARRANGEMENT FOR CLEANING A CONDUIT

[75] Inventor: Garnett E. Jones, Baytown, Tex.

[73] Assignee: Intra-Pipe, Inc., Houston, Tex.

[21] Appl. No.: 641,100

[22] Filed: Dec. 15, 1975

[51] Int. Cl.[2] ..... B24C 3/16; B24C 1/00

[52] U.S. Cl. ..... 51/411; 15/104.06 R; 51/321; 134/22 C; 134/169 C

[58] Field of Search ..... 15/3.5, 104.06 R; 51/8 H, 11, 12, 319, 320, 321; 134/166 C, 167 C, 168 C, 169 C, 22 C, 24

[56] References Cited

U.S. PATENT DOCUMENTS

| | | | |
|---|---|---|---|
| 2,087,694 | 7/1937 | Malmros | 51/8 H X |
| 2,332,984 | 10/1943 | Brackeen | 15/104.06 R |
| 2,388,818 | 11/1945 | Bick | 51/12 X |
| 2,821,814 | 2/1958 | Fritze | 51/8 H X |
| 3,834,082 | 9/1974 | Grudzinski | 51/12 |
| 3,914,815 | 10/1975 | Kobayashi | 51/12 X |

FOREIGN PATENT DOCUMENTS

| | | | |
|---|---|---|---|
| 678,206 | 1/1964 | Canada | 134/167 C |
| 283,460 | 1/1928 | United Kingdom | 15/104.06 R |

*Primary Examiner*—Gary L. Smith
*Attorney, Agent, or Firm*—Jack W. Hayden

[57] ABSTRACT

Storage means receives a particulate material and conduit means are provided for receiving an inert pressurized fluid medium. The conduit means is connected with a conduit such as a pipeline to be cleaned and includes by-pass conduit means for communicating a portion of the inert pressurized fluid medium into the storage means to maintain the particulate material under predetermined pressure. Branch conduit means connected to the conduit means communicates with the storage means for receiving particulate material therefrom and discharging it along with the inert pressurized fluid medium from the inert pressurized fluid medium conduit into the pipeline to be cleaned. Moveable barrier means are mounted in the pipeline against which the inert pressurized fluid medium and the particulate material is propelled. The barrier means includes a deflector for impinging such particulate material against the interior of the conduit thereof. The barrier means is constructed and so that its rate of travel through the conduit to be cleaned and the angle at which such particulate material impinges against the interior thereof may be predetermined.

2 Claims, 2 Drawing Figures

ARRANGEMENT FOR CLEANING A CONDUIT

SUMMARY OF THE INVENTION

Various arrangements have been proposed and are employed for cleaning conduits such as pipelines and the like by conducting fluid under pressure as a propellant for particulate matter through the conduit or pipeline. In order to reduce air pollution at the discharge end of the portion of the pipeline being cleaned, and for economic reasons, it is most desirable to control the amount of the particulate material and propellant discharged into the conduit or pipeline to be cleaned in a manner so as to most efficiently clean the pipeline with a minimum amount of particulate matter and a minimum amount of inert pressurized fluid medium carrier for such particulate matter.

During such cleaning, the discharge of the particulate matter is preferrably conducted under controlled conditions to control the amount of particulate matter employed, and in addition the condition of the pipeline may dictate that the cleaning operation proceed at various rates.

The present invention provides an arrangement for accomplishing the above function and also provides a moveable barrier for positioning in the pipeline against which the inert pressurized fluid carrier medium with the particulate matter may be impinged and deflected to the interior of the conduit. The barrier means is constructed and arranged so that the rate of travel of such barrier through the conduit to be cleaned may be adjusted or varied to suit the internal conditions of the conduit and the degree of cleaning necessary.

Other objects and advantages of the present invention will become more readily apparent from a consideration of the following description and drawings.

DESCRIPTION OF THE PREFERRED EMBODIMENT

Figure 1:
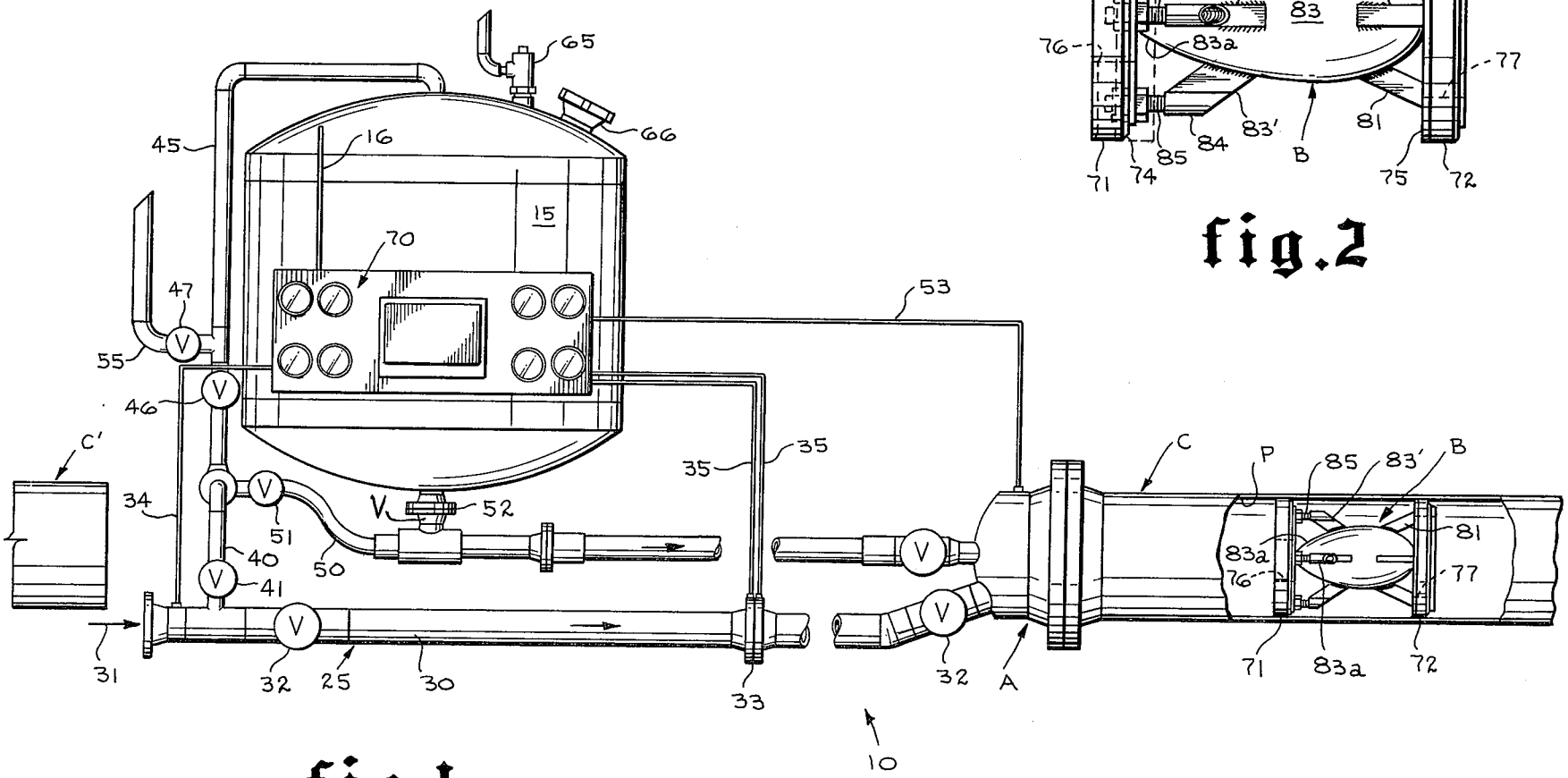
FIG. 1 is a schematic illustration showing the present invention and the arrangement for communicating pressurized fluid to the conduit as well as by passing a portion of such pressurized fluid to the storage means for the particulate material with the barrier means shown positioned in the conduit to be cleaned.

Attention is first directed to FIG. 1 of the drawings wherein the arrangement is referred to generally by the numeral 10.

Such arrangement includes storage means 15 for receiving particulate material therein for subsequent discharge into the conduit or pipeline portion to be cleaned represented generally by the letter C. The conduit portion C to be cleaned is part of and is a continuation of the conduit or pipeline represented at C' and in employing the present invention a portion of the pipeline C' is removed to enable the present invention to be connected with portion C for cleaning thereof. In some circumstances the portion C' will have been previously subjected to the cleaning operation performed by the present invention and after the portions C' and C have been cleaned, the portion removed therebetween to enable cleaning of portion C to be accomplished is then repositioned between C' and C in a manner well known in the art.

The arrangement of the present invention also includes conduit means referred to generally at 25 for connecting with the conduit portion C to be cleaned by any suitable means such as the flanged adapter referred to generally by the letter A. The conduit means 25 includes a first conduit means 30 for receiving an inert pressurized fluid medium as represented by the arrow 31 and conducting it to conduit portion C. Second conduit means 40 are communicated with the first conduit means 30 and include first branch conduit means 45 for conducting a portion of the inert pressurized fluid medium to the storage means 15 to maintain a predetermined pressure on the particulate material therein.

Second branch conduit means 50 communicate with the second conduit means 40 and are also communicated with the storage means 15 for receiving particulate material therefrom to conduct such material and the portion of the inert pressurized fluid medium passing through the second branch means 50 to the conduit C through the flanged adapter A.

The first conduit means 30 includes suitable valve means 32 for controlling flow of propellant, or fluid pressure medium therethrough. The second conduit means 40 also includes valve means 41 for controlling the amount of propellant by-passed from the first conduit means 30 which, in cooperation with the valves 32 predetermined the volume or amount of propellant by-passed through the second conduit means 40 from the first conduit means 30.

An orifice arrangement 33 is provided in the first conduit means 30, and the first conduit means 30 is tapped as shown at 34 on the upstream inlet side with a conduit, and such conduit is connected with the control panel referred to generally at 70 to indicate instrumentally the pressure on such upstream inlet side of the first conduit means 30. The pressure drop across the orifice 33 is communicated to the control panel 70 by the conduits 35 in order that the volume or amount of propellant conducted through first conduit means 30 may be instrumentally noted and controlled by the valve means 32 as desired.

Valve means 46 in first branch conduit means 45 and valve means 51 in second branch conduit means 50 control the flow of propellant through the first and second branch conduit means respectively. The valve 47 in bleed-off conduit means 55 may be employed for selectively controlling the pressure of the inert pressurized medium in the top of the storage means 15 or for bleeding the storage means 15 to atmosphere.

In addition such storage means 15 is provided with a safety pop-off valve 65 as well as an opening 66 through which the particulate material may be discharged into the storage means 15 acting on the particulate material therein.

A conduit 53 is tapped into the flanged adapter A and communicates to the control panel 70 for indicating the pressure in such adapter which reflects the pressure of the inert fluid pressure propellant and particulate material discharged thereinto and subsequently into the conduit C for cleaning.

The second branch conduit means is connected by the outlet 52 in which valve V is positioned through the bottom of the storage means 15 and the particulate material is discharged therethrough and into the inert pressurized fluid propellant passing through the second branch conduit means 50. The rate of discharge of particulate material can be controlled by the amount of pressure from the first branch conduit means 45 acting on the top of the storage container 15; the volume and velocity of the inert fluid propellant passing through the second branch conduit means 50; and the valve V in connection 52 in the bottom of the storage container 15. The valve V may be of any suitable type well known in the art.

Barrier means referred to generally by the letter B form part of the arrangement of the present invention for positioning in the conduit portion C to be cleaned. Such barrier means includes spaced annular seal means 71 and 72 wherein one of such seal means such as seal 71 on the upstream side against which the propellant and particulate material impinges is provided with an annular lip 72' which is urged outwardly into contact with the inner periphery P of the conduit portion C to be cleaned. The seals 71 and 72 may be formed by any suitable elastomer and are secured in position on the barrier means B by the annular support means 74 and 75 respectively. The annular seals 71 and 72 may be secured to their respective annular supports 74 and 75 by any suitable means and the annular support means include openings 76 and 77 respectively for permitting controlled discharge of the propellant and particulate material through the barrier means B for cleaning the pipe and for propelling the barrier means B through the pipe or conduit portion C which is being cleaned.

The annular seals 71, 72 and supports 74, 75, are maintained in longitudinal spaced relation by the construction referred to generally at 80. Such construction 80 includes support members 81 extending from the eliptically shaped surface 83 as shown in the drawings. The eliptically shaped surface 83 is positioned along the longitudinal axis of the barrier means B and provides an arrangement for deflecting the propellant and particulate material against the inner periphery P of the conduit C as well as for controlling the rate of discharge of propellant and particulate material through the barrier means B.

The members 81 extending from the eliptically shaped surface 83 to the annular support 75 may be secured thereto by any suitable means such as welding or the like. The members 83' may be secured at one end by welding to the eliptical shaped surface 83, and at their other end 84 they are provided with threaded extensions 85. The threaded extensions are adapted to be received in openings spaced circumferentially of the support means 74 and each threaded portion or shaft 85 is provided with nut 86 and **86*a*. The shaft portion 85 may be slidably positioned in openings circumferentially arranged in the annular support means 74, and the nuts 86, 86*a* on shafts 85 then tightened against each side of support means 74 to position the nose surface 83*a* of the eliptically shaped member 83 in a predetermined position relative to the opening 76 in the annular support means 74**.

Figure 2:
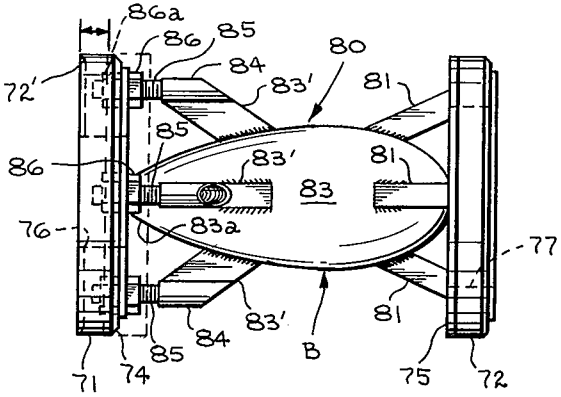
FIG. 2 is an enlarged side view of the barrier means illustrated in FIG. 1.

The position of the nose portion **83*a* relative to the opening 76 will determine the angle of deflection of the propellant and particulate material against the inner surface or periphery P of the conduit C, and will also control the amount and velocity of the particulate material and propellant through the barrier means B. By positioning the nose portion 83*a* longitudinally within the opening 76, the opening 76 is more restricted and thus less propellant and particulate material moves through the opening. This causes the barrier means B to move through C at a desired rate. When the nose portion 83*a* is positioned as shown in FIG. 2, the opening 76 discharges more propellant and particulate material therethrough to engage against the nose portion surface 83 and to be thereafter impinged against the periphery P of the conduit C and to be subsequently discharged through the opening 77 at the other end of the barrier means. When the nose portion 83*a* is positioned away from, or out of opening 76, the barrier means B moves at a different rate than when it projects into opening 76**. Also, the angle of impingement of material on periphery P is different.

At the end of the conduit portion C of pipeline C' to be cleaned, an additional section of pipeline is removed, to enable discharge of the propellant and particulate material to the atmosphere, as well as recovery of barrier means B and reinstallation of the storage means 15 and conduit means 25 and the balance of the invention 10 to clean the next adjacent portion of pipeline.

The preferred type of the pressurized fluid medium is any suitable gas such as by example only, air, natural gas or nitrogen.

The particulate material is an abrasive substance such as sand or the like which is carried by, or entrained by the gas as they move through the pipeline being cleaned.

The foregoing disclosure and description of the invention are illustrative and explanatory thereof, and various changes in the size, shape, and materials as well as in the details of the illustrated construction may be made without departing from the spirit of the invention.

I claim:

1. An arrangement for cleaning conduit such as a pipeline or the like including:

a. storage means for receiving particulate material;

b. conduit means for connecting with the pipeline to be cleaned, said conduit means including:

1. first conduit means for receiving a pressurized gas stream and connected with the pipeline to be cleaned;

2. second conduit means connected to said first conduit means and with said storage means for diverting part of the pressurized gas stream from said first conduit means to communicate with said storage means, said second conduit means including:

first branch conduit means for conducting pressurized gas to said storage means to maintain a predetermined pressure on the particulate material therein; and second branch conduit means connected to said storage means for receiving particulate material from said storage means and commingling it with the pressurized gas in said second branch conduit means, said second branch conduit means being connected to the pipeline to be cleaned whereby the particulate matter and pressurized gas may be conveyed to the pipeline to be cleaned for cleaning thereof;

c. valve means in each said first and second conduit means and in each said first and second branch conduit means for controlling the flow of pressurized gas therethrough;

d. bleed-off conduit means with valve means therein and connected to said first branch conduit means for selectively reducing the pressure in said storage means to atmosphere;

e. means to measure the amount of pressurized gas conducted through said first conduit means to the pipeline to be cleaned;

f. movable barrier means movable in the pipeline by the pressurized gas from said first conduit means and said second branch conduit means, said barrier means including:

1. spaced annular seal means for engaging the interior of the pipeline to be cleaned;
2. support means for said annular seal means including annular members secured to each of said seal means, each of said annular members having an opening for receiving and discharging the pressurized gas therethrough;
3. surface means extending longitudinally between said support means and positioned adjacent the opening in one of said annular members which receives the pressurized gas for directing the gas to impinge on the pipeline to be cleaned; and
4. means adjustably connecting said surface means between said support means of said spaced annular seal means whereby said surface means may be selectively positioned relative to the opening in said one annular member which receives the pressurized gas to adjustably control the angle of impingement of gas against the pipeline to be cleaned and to adjustably control the rate of movement of said movable barrier means through the pipeline to be cleaned.

2. A method of performing internal cleaning of pipeline comprising the steps of:

a. positioning a movable barrier in a pipeline;
b. flowing gas under a desired pressure into the pipeline at a predetermined location;
c. flowing a mixture of gas and an abrasive substance into the pipeline at the predetermined location whereby the gas and abrasive substance flow through the movable barrier to propel it through the pipeline while the barrier deflects the gas and abrasive substance against the interior of the pipe line for cleaning thereof;
d. controlling the rate of flow of gas and abrasive through the movable barrier to control the rate of movement thereof;
e. providing an opening in the pipeline for retrieval of the movable barrier and discharge of the gas and abrasive mixture; and
f. maintaining the gas and abrasive mixture under pressure in the pipeline to propel the barrier at the controlled rate of travel through the pipeline for cleaning thereof by the sand and gas mixture.

* * * * *